US008147900B2

(12) United States Patent
Reichelsheimer et al.

(10) Patent No.: US 8,147,900 B2
(45) Date of Patent: Apr. 3, 2012

(54) MULTIPLE COLOR FLUORESCENCE SECURITY IMPRINT

(75) Inventors: Jay Reichelsheimer, Shelton, CT (US); Bertrand Haas, New Haven, CT (US)

(73) Assignee: Pitney Bowes Inc., Stamford, CT (US)

( * ) Notice: Subject to any disclaimer, the term of this patent is extended or adjusted under 35 U.S.C. 154(b) by 594 days.

(21) Appl. No.: 12/329,974

(22) Filed: Dec. 8, 2008

(65) Prior Publication Data

US 2010/0143578 A1 Jun. 10, 2010

(51) Int. Cl.
*B41M 3/14* (2006.01)
*B44F 1/12* (2006.01)

(52) U.S. Cl. ..... 427/7

(58) Field of Classification Search ..... 427/7
See application file for complete search history.

(56) References Cited

U.S. PATENT DOCUMENTS 5,681,381 A 10/1997 Auslander et al.
6,793,723 B2 9/2004 Auslander et al.
6,827,769 B2 12/2004 Auslander et al.
6,905,538 B2 6/2005 Auslander
7,141,103 B2 11/2006 Auslander et al.
7,141,696 B2 11/2006 Aberg et al.
7,422,158 B2 9/2008 Auslander et al.
2006/0129489 A1* 6/2006 Hersch et al. ..... 705/50

* cited by examiner

*Primary Examiner* — Kelly M Gambetta
(74) *Attorney, Agent, or Firm* — George M. Macdonald; Charles R. Malandra, Jr.; Steven J. Shapiro

(57) ABSTRACT

A method for creating a security mark includes applying a first color fluorescence ink to a substrate and applying a second color fluorescent ink to the substrate is provided. The second color fluorescent ink overlies at least a portion of the substrate where said first color fluorescent ink is applied. A third color is applied to the substrate adjacent the substrate area where said second color fluorescent ink is applied. The first color fluorescent ink, the second color fluorescent ink and the third color border are such that a security mark is formed on the substrate. The blue color fluorescence, the red color fluorescence and the third color on the substrate are such that when viewed through a lens the security mark optical characteristics change. The change is from the optical characteristics of the security mark when the security mark is not illuminated with fluorescence-exciting radiation to a different optical characteristics when the security mark is illuminated with fluorescence exciting radiation.

6 Claims, 4 Drawing Sheets

MULTIPLE COLOR FLUORESCENCE SECURITY IMPRINT

FIELD OF THE INVENTION

The invention disclosed herein relates generally to a security imprints and, more particularly, to a multiple color fluorescence security imprint which inhibits counterfeiting.

BACKGROUND OF THE INVENTION

Various documents employ graphic security. The security is implemented to inhibit counterfeiting of the protected documents. There are many forms of graphic security that exist that are both overt and covert, such as watermarks, pantographs, specialty inks, etc. For the most secure documents such as currency, multiple methods are used.

For example, fluorescent microtext and security threads are used on $100 United States currency bills. This is part of an effort to thwart counterfeiters armed with ever more sophisticated computers, scanners and color copiers. The $100 bills, which features the likeness of Benjamin Franklin, is a frequent target of counterfeiters and, accordingly, the currency protection has progressively been enhanced. In 2007, a security thread was added to the $100 bills. The added security thread combines micro-printing with tiny lenses, in the order of 650,000 lenses for a single $100 bill. The lenses magnify the micro-printing such that when the $100 bill is moved from side to side, the image appears to move up and down. And, when the $100 bill is moved up and down, the image appears to move from side to side. Security thread of this type is also used on the Swedish 1,000 kroner note and has been selected for use by the government of Mexico for some higher-denomination notes.

Another example of the use of documents employing graphic security is shown in U.S. Pat. No. 7,422,158 B2 for FLUORESCENT HIDDEN INDICIUM filed Oct. 24, 2003, and assigned to Pitney Bowes Inc. This patent discloses a printed indicia including a first section and a second section. The first section includes a first ink having a first color under normal daylight. The second section includes a second different ink. The second section includes a fluorescent ink which has a second color under normal daylight which is substantially the same as the first color. The fluorescent ink has a fluorescence when subjected to fluorescence-exciting radiation. The second section is embedded with the first section such that the first and second sections are substantially visually indiscernible from each other in normal daylight.

The above security systems are suitable for certain intended purposes; however, for various other applications, it is desirable to have a simple to implement and detect security mark

SUMMARY OF THE INVENTION

It has been discovered that an easily detectable security mark can be created using a special combination different color fluorescence, such as a substrate having a blue fluorescence with a red fluorescence security mark, in combination with a third color border such as a black color border. A unique visual effect is observed when the media item is illuminated with a fluorescent-exciting radiation such as ultra violet light and viewed through a lens. The lens can be a separate lens or microlenses supported on the substrate. The illustrative embodiments of the present invention described herein provide, among other things, a simple to implement and detect security mark.

A method for creating a security mark embodying the present invention includes the steps of applying a first color fluorescence ink to a substrate and applying a second color fluorescent ink to the substrate. The second color fluorescent ink overlies at least a portion of the substrate where said first color fluorescent ink is applied. A third color is applied to the substrate adjacent the substrate area where said second color fluorescent ink is applied. The first color fluorescent ink, the second color fluorescent ink and the third color are such that a security mark is formed on the substrate.

A method for creating a security imprint also embodying the present invention includes the steps applying a blue color fluorescence to a substrate and applying a red color fluorescence to the substrate to form a security mark. A third color is applied adjacent the security mark. The blue color fluorescence, the red color fluorescence and the third color on the substrate are such that when viewed through a lens the security mark optical characteristics change from the optical characteristics of said security mark when said security mark is not illuminated with fluorescence-exciting radiation to a different optical characteristics when said security mark is illuminated with fluorescence exciting radiation.

A substrate having a security imprint thereon embodying the present invention includes the substrate having an area with a first color fluorescence and a second color fluorescence on the substrate and overlapping at least a portion of the first color fluorescence area on the substrate. The second color fluorescence forms a security mark. A third color border is adjacent the security mark.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PRESENT INVENTION

Figure 1:
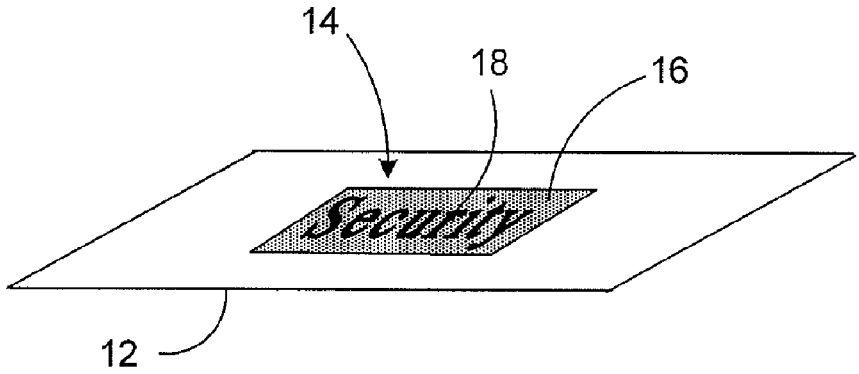
FIG. 1 is a prospective view of a substrate having a security mark with multiple fluorescent colors embodying an illustrative embodiment of the present invention.

A visible or invisible red fluorescent security mark is printed on a substrate, a media item such as paper that contains a high level of optical brighteners, usually blue fluorescence. A media can be described as having high level of optical brightener content if it exhibits strong blue fluorescence under UV excitation. More specifically the brightness content can be measured using a spectrophotometer with a d/8 measuring geometry. The reflectance at 457 nm will be greater than 105%. One suitable device for making such measurements is a Perkin Elmer Lambda 900 spectrophotometer with an integrating sphere. The security mark is surrounded by a dark color border such as a black border. The substrate is then stimulated with a known fluorescent-exciting radiation, such as ultraviolet excitation in the range, for example, of 254 nm or 365 nm. The energy causes both the paper and the ink to fluoresce. Using a lens, the document is viewed. If the security mark appears to holographically float above the surface of the paper, the document is proven to be secure. Other colors may be employed. For example, Pitney Bowes Inc. markets a black color ink that contains red fluorescence, hereinafter referred to a black fluorescence. This type ink is disclosed in U.S. Pat. No. 7,141,103 for PHOTOSENSITIVE OPTICALLY VARIABLE INK COMPOSITIONS USEFUL FOR INK JET PRINTING filed Jun. 22, 2004; U.S. Pat. No. 6,827,769 for PHOTOSENSITIVE OPTICALLY VARIABLE INK HETEROGENEOUS COMPOSITIONS FOR INK JET PRINTING filed Apr. 10, 2002; and, U.S. Pat. No. 6,793,723 for HOMOGENEOUS PHOTOSENSITIVE OPTICALLY VARIABLE INK COMPOSITIONS FOR INK JET PRINTING filed May 9, 2002; all of which are assigned to Pitney Bowes Inc. Moreover, the red fluorescence can be either a visible red fluorescence ink or an invisible red fluorescence ink. The viewing lens and fluorescent-exciting radiation light can be self contained in an authenticating box and supplied as a complete unit or, as shown in the drawings, be a separate lens and a separate light. It should be noted that the security ink can be printed using any known printing method, such as offset, inkjet, screen printing, etc.

In an alternate arrangement, the blue fluorescence is contained within the ink itself. Thus the security mark can be printed on any substrate as does not depend on the blue or other color fluorescence being provided by the optical brighteners in the substrate. The single ink is a mixture that contains an ink with red fluorescence properties and an ink with blue fluorescence properties. In another arrangement, microlenses are placed on the substrate and only an activating light is needed to authenticate the document.

Reference is now made to FIG. 1, a substrate 12 has a security mark generally shown at 14 imprinted thereon, the security mark includes a black border 16 and an area of the security mark 18. Other color borders such as dark colors can be employed so long as the holographic optical effect is discernable when the substrate is viewed through a lens and illuminated with fluorescence exciting radiation. The nature of the security mark is a matter of design choice. The security mark can be words, logos, drawings, arbitrary marks or splotches, all of which are called for the purposes of this application a security mark. Security mark text of various font sizes are suitable for the security imprint. For example, 6 point to 16 point font size text exhibit the desired optical characteristics when imprinted with the inks and in the manner disclosed herein.

The substrate 12 is a substrate that contains brighteners which when radiated with ultraviolet light fluoresces blue. The security mark 18 is imprinted over the black border 16 with a red fluorescent ink. The red fluorescent ink can be a visible red fluorescent ink or an invisible red fluorescent ink. Additionally, the red fluorescent ink can be a black color ink which contains red fluorescence.

Examples of the types of inks that may be employed in addition to those noted above are Invisible Red Fluorescent inks that can be used in the various security imprints are described in U.S. Pat. No. 6,905,538 for INVISIBLE INK JET INKS filed Dec. 30, 2002. Red Fluorescent inks are described in U.S. Pat. No. 5,681,381 for FLUORESCENT RED AND MAGENTA WATERFAST INK JET INKS filed Dec. 11, 1995 and U.S. Pat. No. 7,147,696 for FLUORESCENT WATER BASE INK FOR INK-JET RECORDING filed Aug. 12, 2004. These three patent are each assigned to Pitney Bowes Inc.

Figure 2:
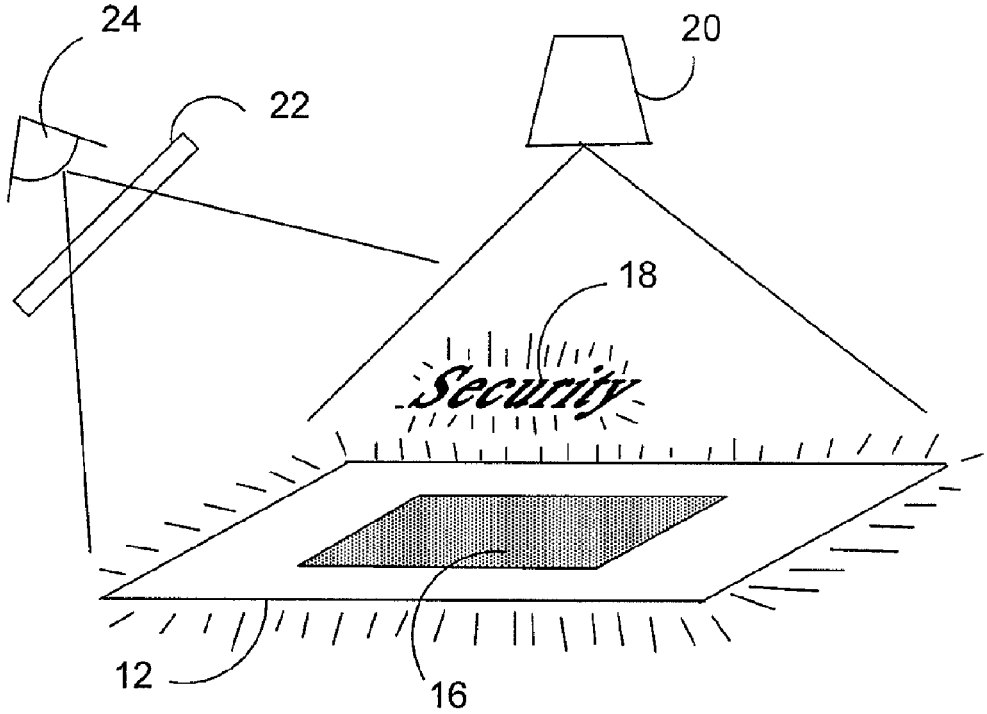
FIG. 2 is a prospective view of FIG. 1 with the substrate illuminated with fluorescent energizing radiation when viewed through a lens.

Reference is now made to FIG. 2. The substrate 12 shown in FIG. 1 is irradiated with ultraviolet light by the light source 20 the substrate is viewed through a lens 22 as shown by the marking 24. The security mark 18 appears to float above the surface of the substrate 12. The floating of the security mark above the substrate is an evidence of authenticity of any substrate such as a document employing the security mark. This change is illustrated when passing from FIG. 1 to FIG. 2. The substrate 12 which may be paper or other substrate such as cardboard or plastic. The fluorescing areas are depicted by the by the various lines surrounding the substrate 12 as is the floating security mark 18. The lens and light employed may be a UV lamp such as the Spectroline ENF-260C from Spectronics Corporation of Westbury, N.Y. The lens can be any which provides approximately 2× magnification such as glass lens 16353LG from Luxo of Elmsford, N.Y. or a plastic Fresnel lens such as NT32-684 from Edmund Optics of Barrington, N.J.

Figure 3:
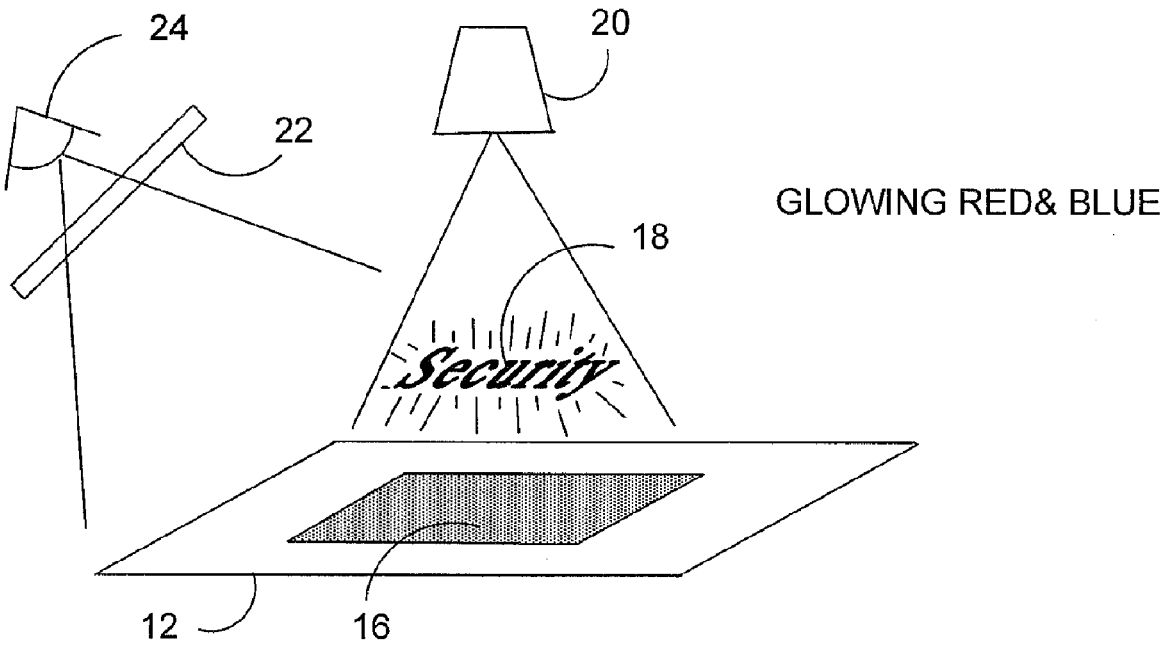
FIG. 3 is an alternate embodiment of the arrangement shown in FIG. 2 where the security mark is imprinted with two different fluorescent color inks and the substrate does not contain have a fluorescent material.

Reference is now made to FIG. 3. This is an alternate embodiment where the substrate 12 does not contain a fluorescent material and a fluorescent blue ink is mixed with the visible fluorescent red ink to form the security mark. The unexcited view of the embodiment shown in FIG. 3 would appear the same as or similar to that shown in FIG. 1; however, when the substrate 12 is irradiated with ultraviolet light and viewed through the lens 22 the security mark 18 would appear to float above substrate 12. The substrate 12 does not fluoresce. Since the substrate 12 does not contain a blue fluorescent material in the substrate there is no fluorescence from the substrate when it is irradiated with ultraviolet light from light source 20. A suitable ink which is a mixture of a blue fluorescent ink and a red fluorescent ink is approximately 75% red fluorescent and 25% blue fluorescent ink; however, other mixtures are suitable provided the desired optical characteristics are displayed. A wide range of mixtures may be suitable as the substrate may have low levels of blue fluorescence that would combine with the blue fluorescence in the ink to provide the level of blue fluorescence to achieve the desired optical characteristics.

Figure 4:
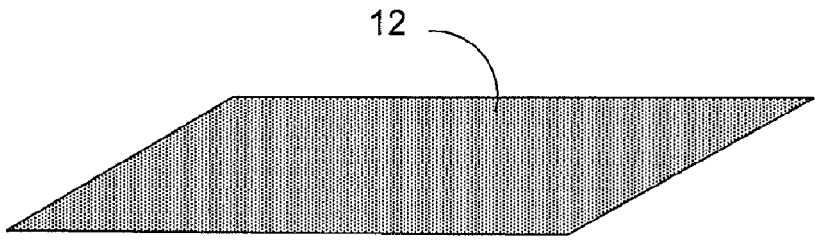
FIG. 4 is an another illustrative embodiment of the present invention where the substrate is a black substrate.
Figure 5:
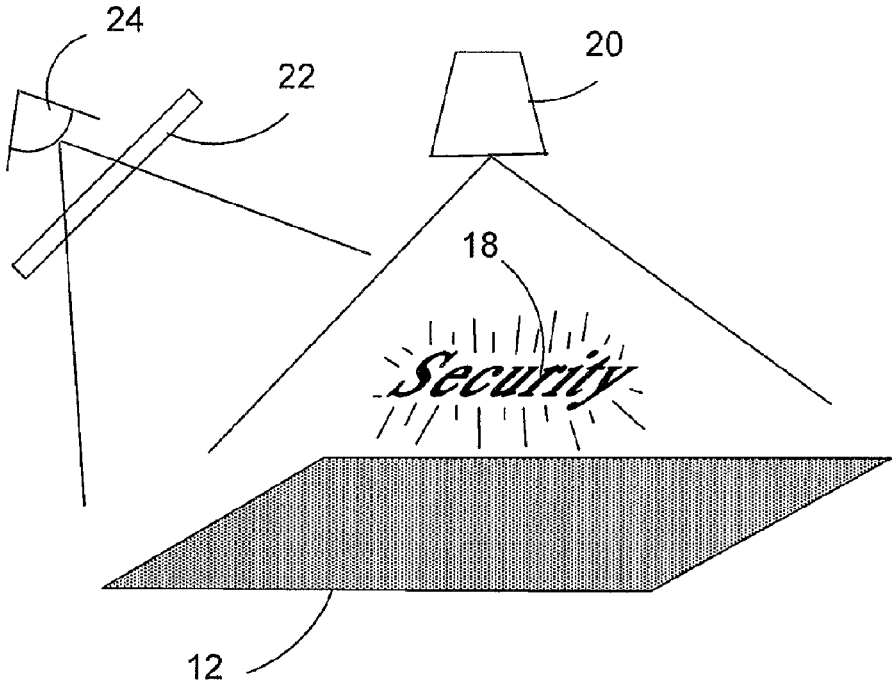
FIG. 5 is a prospective view of FIG. 4 where the substrate has been illuminated with fluorescent exciting radiation and viewed through a lens.

Reference is now made to FIG. 4. In FIG. 4 the substrate 12 is a black substrate. Accordingly, when the security mark is imprinted on the substrate 12 with invisible red fluorescent ink or black color ink with red fluorescence, no security mark is visible when the substrate is not irradiated with ultra violet light as is shown in FIG. 4;

Reference is made to FIG. 5 wherein the substrate shown in FIG. 4 is irradiated with ultraviolet light. The security mark 18 becomes visible and appears to float above the surface of the substrate 12. There is no need to have a dark color, such as the black color border shown in FIG. 3 since the substrate is black.

Figure 6:
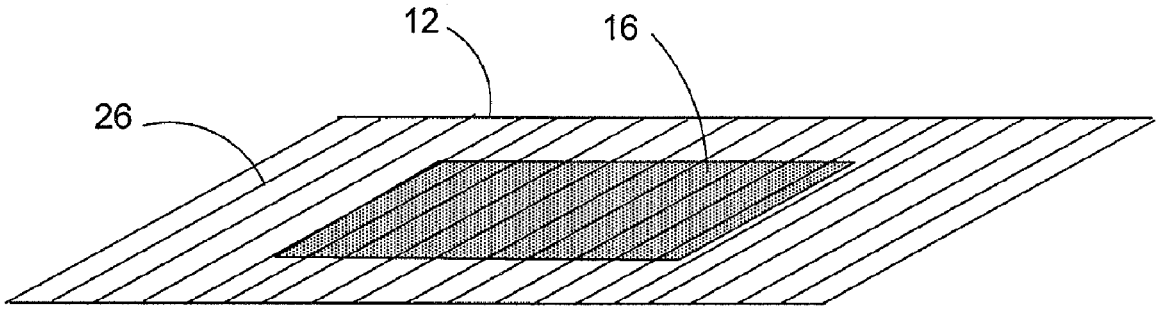
FIG. 6 is a prospective view of yet another illustrative embodiment of the present invention utilizing microlenses to replace the lenses shown in FIGS. 2, 3, and 5.

Reference is now made to FIG. 6 which shows an embodiment of the multiple color fluorescent security imprint that does not require a separate lens for viewing security mark.

Figure 7:
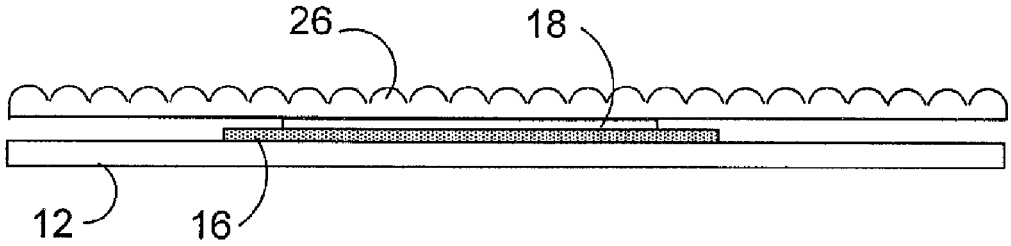
FIG. 7 is an edge view, not to scale, and greatly enlarged, illustrating features of the prospective view of the substrate and structure shown in FIG. 6; and, FIG. 8 is a prospective view of the substrate with the security mark shown in FIG. 6 and illuminated by fluorescent exciting radiation when viewed without a separate lens.

The substrate 12 includes a black border 16 and security mark that is printed in invisible red fluorescent ink or black color ink with red fluorescent ink on the black border 16. Above the black border and the ink security mark are microlenses supported on the substrate 26. The micro lens 26 substitutes for the lens 22 shown in the prior figures. The organization of the various layers is clearly shown in FIG. 7 where the substrate 12 has a black area or border 16. On top of the back border or area 16 a security mark 18 is applied. The security mark 18 can be any of the inks previously noted and the substrate 12 can be a black substrate such that the black border 16 is not required. The security mark 18 is below a micro lens surface 26.

Figure 8:
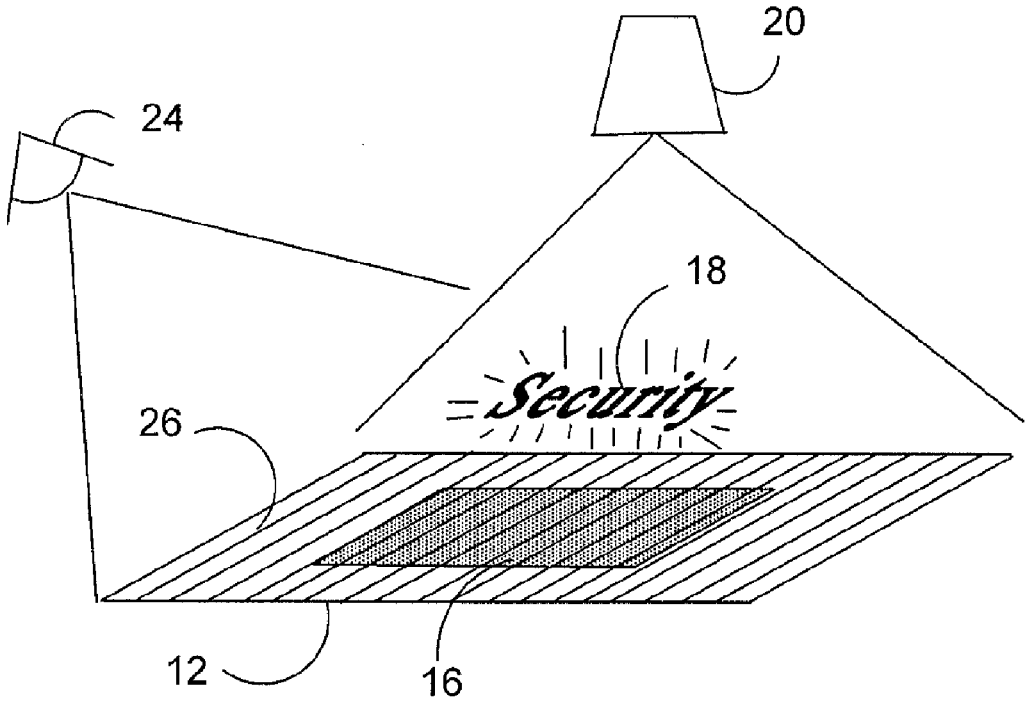

Reference is now made to FIG. 8. When the substrate 12 is irradiated by the ultraviolet light source 20 the security mark becomes visible and appears to float above the substrate 12. The security mark 18 is showing as fluorescing while the substrate is not showing as fluorescing. This is because the security mark 18 has been imprinted with ink that contains both blue fluorescent ink and red fluorescent ink. The substrate 12, however, could be made to be fluorescent and the security mark ink would not need to contain a fluorescent blue ink.

It should be noted that as used herein red fluorescent ink includes visible red fluorescent ink, invisible red fluorescent ink and black color ink with red fluorescence. Also, the terms fluorescent and fluorescence are used interchangeably. The level of fluorescence and the order or layers of fluorescent inks or fluorescence materials can be interchanged so long as the desired optical characteristics are obtained. That is, the security mark optical characteristics change. The change is from the optical characteristics of the security mark when the security mark is not illuminated with fluorescence exciting radiation to different optical characteristics when the security mark is illuminated with fluorescence exciting radiation. Moreover, the inks may be on the surface of the substrate, be absorbed into the substrate or be materials used in the manufacturing process. These techniques are interchangeable to provide the needed colors and fluorescence properties. The dark color is adjacent the security mark and can also be under the security mark. The dark color adjacent the security mark can be a full border or partial border, surrounding all or part of the security mark, as the case may be.

While the present invention has been disclosed and described with reference to the several embodiment thereof, it will be apparent, as noted above that variations and modifications may be made therein. It is, thus, intended in the following claims to cover each variation and modification that falls within the true spirit and scope of the present invention.

What is claimed is:

1. A method for creating a security mark, comprising the steps of:

applying a first marking comprising a non-fluorescent ink to said substrate adjacent said substrate area where said first fluorescent ink is applied;

applying a second marking comprising a fluorescence ink to a substrate, wherein the fluorescent ink comprises a mixture of a red fluorescent ink and a blue fluorescent ink; and wherein, said first marking and second marking, when viewed through a lens and illuminated with fluorescence exciting radiation, will cause said first marking to appear to float over the substrate, wherein said first marking surrounds, but does not overlap said second marking.

2. The method for creating a security mark as defined in claim 1 wherein said second marking comprises text characters.

3. The method for creating a security mark as defined in claim 1 wherein said non-fluorescent ink comprises ink of approximately black color.

4. The method for creating a security mark as defined in claim 1 further comprising, applying a micro lens to the substrate.

5. A method for creating a security mark, comprising the steps of:

applying a first marking comprising a non-fluorescent ink to said substrate adjacent said substrate area where said first fluorescent ink is applied;

applying a second marking comprising a fluorescence ink to a substrate, wherein the fluorescent ink comprises a mixture of a red fluorescent ink and a blue fluorescent ink; and wherein, said first marking and second marking, when viewed through a lens and illuminated with fluorescence exciting radiation, will cause said first marking to appear to float over the substrate, wherein said first marking surrounds and underlies said second marking.

6. A method for creating a security mark, comprising the steps of:

applying a first marking comprising a non-fluorescent ink to said substrate adjacent said substrate area where said first fluorescent ink is applied;

applying a second marking comprising a fluorescence ink to a substrate, wherein the fluorescent ink comprises a mixture of a red fluorescent ink and a blue fluorescent ink; and wherein, said first marking and second marking, when viewed through a lens and illuminated with fluorescence exciting radiation, will cause said first marking to appear to float over the substrate, wherein said non-fluorescent ink comprises ink of approximately black color and is first coated over the entire substrate.

* * * * *